United States Patent [19]

Lehner

[11] 4,254,536

[45] Mar. 10, 1981

[54] FIBER CUTTER

[75] Inventor: Peter Lehner, Hingham, Mass.

[73] Assignee: Leigh Fibers Incorporated, Boston, Mass.

[21] Appl. No.: 108,019

[22] Filed: Dec. 28, 1979

[51] Int. Cl.[3] ..... D01G 1/04

[52] U.S. Cl. ..... 19/0.6; 19/115 R; 83/913

[58] Field of Search ..... 190/0.3, 0.48, 0.6, 190/0.62, 115 R; 83/913

[56] References Cited

U.S. PATENT DOCUMENTS

| | | | |
|---|---|---|---|
| 2,719,336 | 10/1955 | Stotler | 19/0.51 |
| 2,830,327 | 4/1958 | Wildbolz | 19/0.6 |
| 2,846,728 | 8/1958 | Wildbolz | 19/0.6 |
| 3,103,304 | 9/1963 | Nawalanic | 19/0.6 |
| 3,763,561 | 10/1973 | Scharfenberger | 83/913 X |
| 3,831,473 | 8/1974 | Fleissner | 83/913 X |
| 3,915,042 | 10/1975 | Laird | 83/913 X |

FOREIGN PATENT DOCUMENTS

| | | | |
|---|---|---|---|
| 757371 | 12/1952 | Fed. Rep. of Germany | 19/0.6 |
| 439691 | 4/1968 | Japan | 19/0.6 |

*Primary Examiner*—Louis Rimrodt

[57] ABSTRACT

Short lengths of uniform length are cut from a mass of non-oriented fibers by combing and periodical cutting.

6 Claims, 1 Drawing Figure

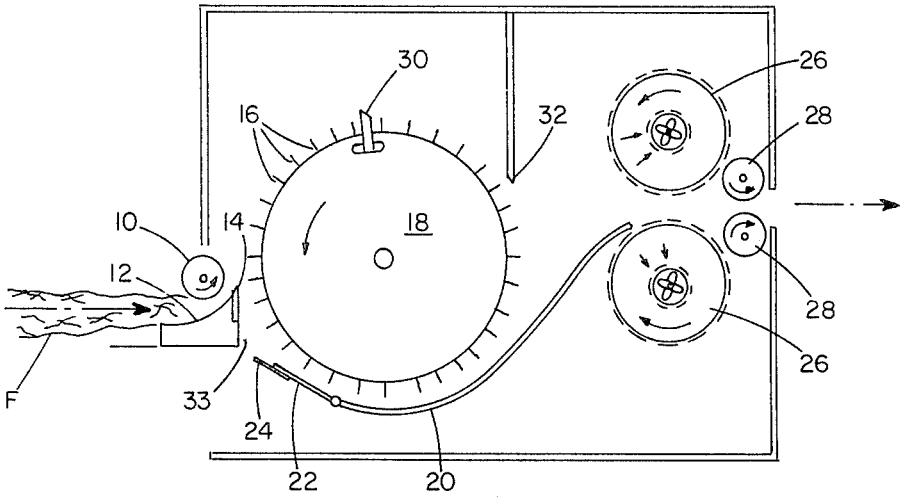
30
26
16
32
28
10
14
18
12
28
26
F
33
24
22
20

FIBER CUTTER

FIELD OF THE INVENTION

This invention relates to the cutting into uniform short lengths of fibers constituting a tangled mass.

BACKGROUND OF THE INVENTION

It is known in the prior art to cut short lengths of fibers from a tangled, non-oriented, mass using a device known in the art as a granulator. It is also known in the prior art to cut regimented lengths of fiber into short lengths using a cutter roll (e.g., U.S. Pat. No. 2,719,336). Finally, it is known to use carding rolls in order to orient fibers.

SUMMARY OF THE INVENTION

I have discovered that very uniform short lengths may be cut from a batt of non-oriented fibers by passing the batt between a feeder roll and a first knife blade spaced from a rotating picker roll carrying at least a second knife positioned for cutting action operatively with the aforementioned blade.

I have discovered also that the pieces cut off may be suitably classified to separate too-short pieces and satisfactory pieces by providing, in combination, a dropout below and just downstream of said aforementioned first knife blade and drawing satisfactory pieces through the device thereover with the help of downstream vacuum.

PREFERRED EMBODIMENT

I turn now to a description of the drawing, structure, and operation of a preferred embodiment of the invention.

DRAWING

The single FIGURE illustrates diagrammatically a device according to the invention.

STRUCTURE

There is shown in the FIGURE a tangled mass or batt of non-oriented long thermoplastic (e.g., polyester) fibers F. Feed roll 10 (elastomeric covered, 4 11/16 inches in diameter) acting against feed plate 12 advances the batt F against blade 14 and into contact with pins 16 of picker cylinder 18; pins 16 project ¾ inch from the surface of picker cylinder 18, and are pointed. Fixed belly portion 20, pivotal belly portion 22, and slidable belly portion 24 define with picker cylinder 18 a path through the device. Downstream thereof are a pair of evacuated perforated rolls 26 and a pair of delivery rolls 28. Fly knife 30 is mounted on picker roll 18 and extends 2 millimeters further radially from the surface of the drum than do pins 16. Doctor blade 32 prevents recycling.

OPERATION

In operation, tangled batt F is fed by feed roll 10 (rotating at 11 rpm) over doctor blade 14. Picker roll 18 rotates (at 720 rpm) so that the pins 16 thereof comb batt F as it is held between feed roll 10 and blade 14. Blade 14 is set at a distance away from picker roll 18 corresponding to the length of the desired finished product, here 0.23 inch.

Feed roll 10, which is 4 11/16 inches in diameter in the preferred embodiment, rotates slowly, so that ¼ inch is fed for each full rotation of the forty-inch diameter picker wheel 18 (720 rpm), knife 30 cooperating with the knife edge of blade 14 in a slight shearing action (blade 30 has a 3° skew) to cut the fibers to the desired length after pins 16 have combed them into alignment.

The size, both in a generally radial direction and in a generally circumferential direction, of the opening just downstream of blade 14, is regulated by pivoting the portion 22 and sliding the portion 24. A third variable is the rate at which a fan (not shown) exhausts air through the perforated rolls 26. In the preferred embodiment evacuation rate is 4,000 cubic meters per minute, the device being 4 feet in width. The nature of the opening 33 and the amount of evacuation are adjusted so that desirably short bits of fiber drop out through the opening 33, while the undesirably long pieces of fiber are entrained and pass on through the device.

The device and the method of its operation are especially advantageous for thermoplastic fibers. For one thing, the large diameter of the picker roll 18 and its slow rate of rotation provide for cooling between successive cuts. This cooling is further aided by the air drawn through the cut fiber passage by the vacuum pulled at perforated rolls 26. The device and method are, however, quite useful with non-thermoplastic fibers.

OTHER EMBODIMENTS

If desired, more than one knife 30 may be spaced equally around the periphery of the picker roll 18; with two, for example, the same rate of rotation of the roll 18 would produce cut pieces half as long.

The pinch point between feedroll 10 and blade 14 should be positioned as closely to picker roll 18 as may be accomplished consistently with pin clearance of blade 14. Because of this, for shorter lengths of cut pieces, a smaller diameter feedroll 10 should be used.

What is claimed is:

1. A device for producing short lengths of fiber from a non-oriented batt of fibers which comprises a transversely-extending first knife, a feedroll mounted to cooperate with said batt and said first knife to move said batt across said first knife, guide means to guide said batt between said feedroll and said first knife, a combing roll mounted for rotation about a transverse axis adjacent said first knife, said combing roll having a cylindrical outer surface, a multiplicity of pins extending therefrom, and at least one second knife blade carried thereby and extending generally transversely for cooperation with said first knife blade to provide a cutting action.

2. The device of claim 1 which includes a belly plate cooperating with said combing roll to provide a passage thereby for cut fiber pieces and vacuum means downstream thereof for urging said fiber pieces through said passage.

3. The device of claim 2 in which an opening is provided in said passage therebeneath downstream of said first knife.

4. The device of claim 3 in which adjustment means for varying the configuration of said opening is included.

5. The device of claim 4 in which there are both generally radially opening adjustment means and generally circumferential opening adjustment means.

6. The device of claim 1 in which said combing roll is of diameter larger than said feedroll.

* * * * *